US006001137A

United States Patent [19]

Alfekri et al.

[11] Patent Number: 6,001,137

[45] Date of Patent: Dec. 14, 1999

[54] INK JET PRINTED TEXTILES

[75] Inventors: Dheya Alfekri, San Diego; Gary Staley, La Canada; Bob Chin, San Diego; Brian Hardin, San Diego; Cincin Siswanto, San Diego, all of Calif.

[73] Assignee: Encad, Inc., San Diego, Calif.

[21] Appl. No.: 09/041,476

[22] Filed: Mar. 11, 1998

Related U.S. Application Data

[60] Provisional application No. 60/076,197, Feb. 27, 1998.

[51] Int. Cl.[6] ..... D06P 1/52; D06P 1/56; D06P 1/66

[52] U.S. Cl. ..... 8/445; 8/495; 8/551; 8/554; 8/606; 8/595; 8/922; 8/918

[58] Field of Search ..... 8/445, 551, 606, 8/595, 495

[56] References Cited

U.S. PATENT DOCUMENTS

| | | | |
|---|---|---|---|
| 2,595,935 | 5/1952 | Daniel, Jr. et al. . | |
| 4,341,098 | 7/1982 | Otting . | |
| 4,369,041 | 1/1983 | Dvorsky et al. . | |
| 4,410,652 | 10/1983 | Robinson et al. . | |
| 4,423,223 | 12/1983 | Hall et al. . | |
| 4,436,524 | 3/1984 | Valenti . | |
| 4,439,203 | 3/1984 | Runyon et al. . | |
| 4,452,606 | 6/1984 | van Diest et al. . | |
| 4,554,181 | 11/1985 | Cousin et al. | 427/261 |
| 4,599,078 | 7/1986 | Heller et al. | 8/495 |
| 4,599,087 | 7/1986 | Heller et al. . | |
| 4,629,470 | 12/1986 | Harper, Jr. . | |
| 4,702,742 | 10/1987 | Iwata et al. | 8/495 |
| 4,725,849 | 2/1988 | Koike et al. . | |
| 4,743,266 | 5/1988 | Harper, Jr. . | |
| 4,832,856 | 5/1989 | Rutzen et al. . | |
| 4,913,829 | 4/1990 | Rutzen et al. . | |
| 5,073,448 | 12/1991 | Vieira et al. | 428/331 |
| 5,228,161 | 7/1993 | Scatizzi . | |
| 5,403,358 | 4/1995 | Aston et al. | 8/445 |
| 5,580,481 | 12/1996 | Sakata et al. . | |
| 5,631,684 | 5/1997 | Takaide et al. | 347/100 |

*Primary Examiner*—Margaret Einsmann
*Attorney, Agent, or Firm*—Knobbe, Martens, Olson & Bear, LLP

[57] ABSTRACT

Waterfast ink jet printing onto textiles is performed by treating the textiles with a polymer or copolymer of epihalohydrin prior to the ink jet printing process. A softener such as a tetraalkylammonium salt may also be used, as may be a cationic binder.

17 Claims, 1 Drawing Sheet

INK JET PRINTED TEXTILES

CROSS REFERENCE TO RELATED APPLICATIONS

This application claims priority under 35 U.S.C. § 119(e) to U.S. Provisional Application Ser. No. 60/076,197 filed on Feb. 27, 1998, entitled "Treatment for Textile Substrate".

FIELD OF THE INVENTION

This invention relates to a method for textile printing using an ink jet process where the textile has been treated with materials to improve the color intensity and waterfastness of the ink.

BACKGROUND OF THE INVENTION

In the textile printing industry, many chemicals have been applied to cloth to improve the quality and permanence of the colors and patterns which are printed on the fabric. For example, polymeric compounds obtained by the reaction of epihalohydrin with a polyalkylene polyamine have been used as textile treatment agents for hydroxy group-containing fibers, such as cellulose, especially cotton, and nitrogen-containing fibers, for example polyacrylonitrile and natural or synthetic polyamides such as wool, silk or nylon. When used as pretreatment agents, the polymers improve the color yield of the subsequent dyeing and allow for shorter dyeing times. When used as aftertreatment agents, they improve waterfastness.

To create printed clothing, various printing methods such as roller printing, screen printing, transfer printing, etc. have been used. The conventional methods require preparation of print plates or screen plates. Because preparation of these transfer devices is expensive, it is not cost effective to prepare the print plates or screen plates unless the printed cloth is produced in large quantities.

The period of fashion for printed clothing is often quite short, and new printing plates with a different design have to be made at frequent intervals at great expense. In addition, changes in fashion can lead to large stockpiles of out-of-fashion prints. There is a need for a method of printing textiles in which patterns can be changed rapidly and inexpensively, so that the produced printed fabrics can be prepared in a timely manner and in batches small enough that they do not lead to large quantities of out-of-fashion prints.

In order to meet these needs, textile printing by an ink jet process has been proposed. There are difficulties in printing fabrics by the ink jet process, however. Fabrics are normally printed with a high viscosity liquid. High viscosity liquids are not appropriate for printing with the ink jet process, because they do not flow well enough to be applied through the ink jet nozzle. Low viscosity inks which are deposited onto fabric by the ink jet process are prone to spreading, because fabric does not retain ink very well. In addition, fabric often has texture, and the texture can increase the spreading of the ink on the fabric. Furthermore, even if the dye in the ink is deposited evenly, the levelling properties of the dye which is deposited by the ink jet process is unstable and changes with time, and the dye is often not fixed well onto the fabric. Considerable difficulty has been encountered in creating ink jet printed textiles which are washable without substantial degradation in color density.

Various methods of textile coating and treatment have been attempted to address these difficulties. For example, compounds such as starch, cellulose, gum arabic, and polyvinylacetate have been placed onto fabric before forming a pattern on the fabric with ink jet printing in order to reduce spreading or wicking of ink. Although the methods are an improvement over simply using uncoated fabric, the patterns are found to not be nearly as sharp as patterns produced with conventional printing technology, and the textiles are not washable without losing significant color intensity. There is thus a need in the art for a textile treatment process which produces washable and high quality textile prints which have been printed with an ink jet printing process.

SUMMARY OF THE INVENTION

Figure 1:
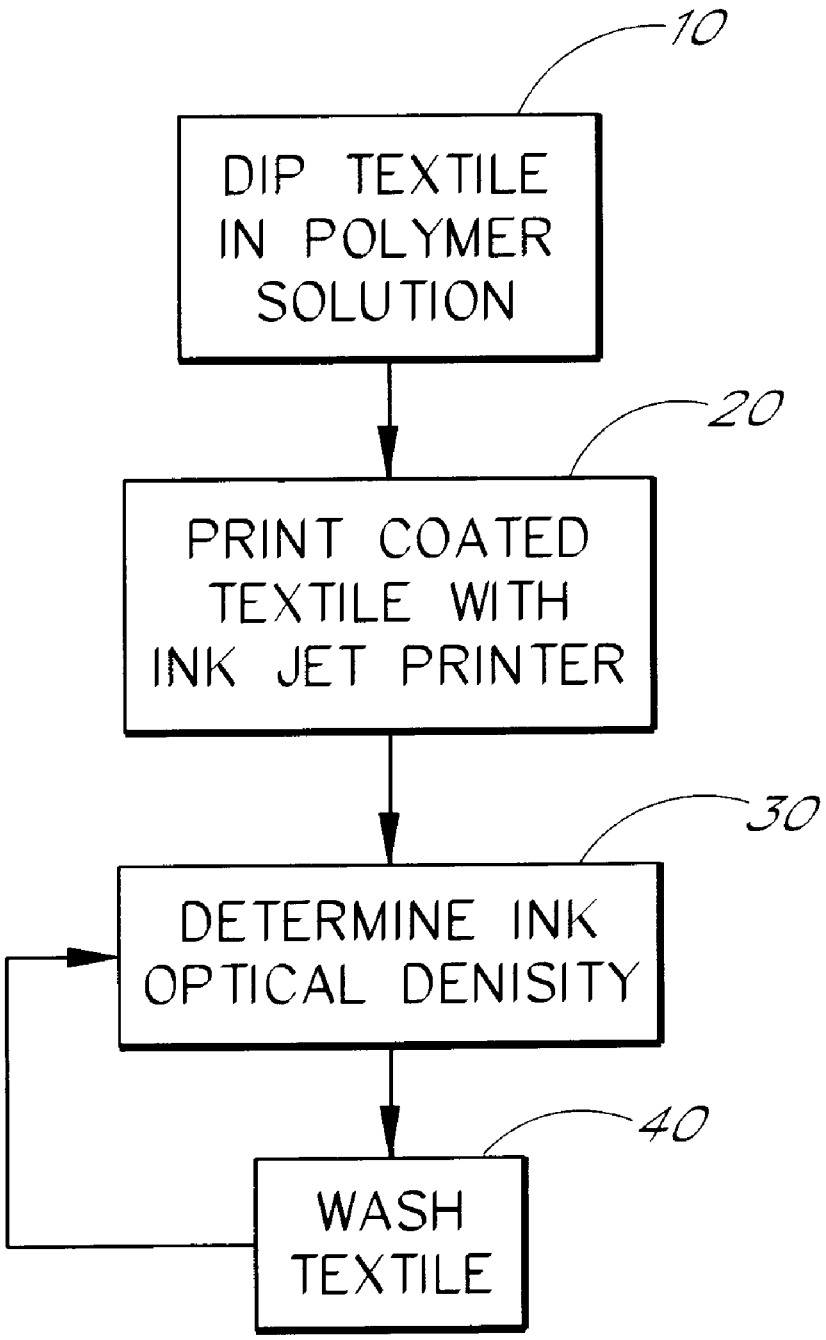
FIG. 1 is a flow chart illustrating one aspect of the present invention.

The present invention provides ink jet printed textile products and methods of producing them which exhibit superior dye waterfastness and excellent softness of hand and feel. The fabric washability provided by the present invention has never before been achieved for ink jet printed textile products.

In some advantageous embodiments, waterfastness is provided by treating a desired fabric with a polymer or copolymer comprising an epihalohydrin and polyalkylene polyamine. In other embodiments, a cationic softener is used which may comprise a alkylammonium salt such as a quaternary fatty amide. In other embodiments, a combination of the polymer/co-polymer and softener are used. In one specific embodiment, a method of making a printed textile having a waterfast print pattern and supple feel comprises immersing the textile substrate in a solution comprising (1) approximately 0.05 to 40% by weight epihalohydrin copolymerized with polyalkylene polyamine and (2) approximately 0.01 to 10% by weight softener comprising an alkylammonium salt. The textile substrate is dried, and ink droplets are ejected onto the surface of said textile substrate to form the waterfast print pattern. These ingredients may also be supplemented by an additional cationic binder. The binder may comprise an acrylic copolymer with a cationic moiety.

It is one beneficial aspect of the present invention that the compounds described for providing waterfastness and excellent feel work well for both natural and synthetic fabrics. For polyester, especially good results are obtained if a suitable curing step is provided. As an additional mordant for polyester material, tannin salt has been found to be effective.

DETAILED DESCRIPTION OF THE PREFERRED EMBODIMENT

The present invention provides a method for printing on textile fibers with an ink jet printing system by treating the textile with one or a combination of chemicals. Although the chemicals can be applied either before or after the ink jet printing process, it is preferred that at least one of the chemicals be applied before the printing process. In general, it is advantageous to apply all of the chemicals which are to be coated on the fabric before the ink jet printing process.

The chemicals which are applied to the fabric can include one or more ink/dye chemically compatible coating materials, softener receptors, and/or binders. Each of the chemicals can be applied separately or together. It has been found that the three types of chemicals act synergistically together, however, and it is generally preferred, though not required, that at least two of the chemicals are applied to the fabric.

The coating materials are capable of binding to both natural and synthetic fibers, woven or knitted. The material can act as a mordant to help fix the water-based ink jet ink dye to the fabric, improving the sharpness of the design of the ink image applied through the ink jet printing process, and improving the waterfastness of the dye.

Although a variety of materials can be used, it is generally preferred that the ink compatible material be a polymer, a copolymer, or a mixture of the two. Although a variety of polymers or copolymers can be used, both natural and synthetic, it is advantageous that the polymer or copolymer be cationically charged. Although we do not wish to be bound to a theory as to why a cationically charged polymer gives such exemplary results, one possible reason is that anionically charged dyes are electrostatically attracted to the cationically charged polymer or copolymer. The cationically charged polymer may therefore act as a mordant to immobilize the anionically charged dye through electrostatic attraction so that it does not spread, diffusing the printed pattern.

One especially preferred type of polymer is the reaction product of polyalkylene polyamine with an epihalohydrin or a precursor thereof. Some examples of such polymers and copolymers are described in U.S. Pat. No. 4,599,087 to Heller et al. and U.S. Pat. No. 4,452,606 to van Diest et al., the disclosures of both of which are hereby incorporated by reference in their entireties. Dichlorohydrin and epichlorohydrin are advantageous reagents, particularly epichlorohydrin. The amines N-methylpyridine, dimethylpyrazine, and caprolactam are exemplary amines as precursors for the polyalkylene polyamines.

One preferred polymer/copolymer for use in the present invention is Index, available as a 25% solids solution in water from Centigrade Chemicals of Carrol Springs, Fla. Other suitable polymers include Pretreat 100, a 20.5% solids solution in water and P-CD, a 33.8% solids solution in water, both available from Excel Products of Newport Beach, Calif. The Pretreat 100 and P-CD polymers are polymers containing mostly epichlorohydrin.

Although the polymer or copolymer can be applied to the fabric in various ways, the polymer can advantageously be dissolved in water or other suitable solvent, most preferably water, and the solution applied to the fabric. The application of the solution can be carried out by padding, dipping, spraying, foam application, roll coating, rod coating, reverse gravure coating, slot coating, flexo, offset, or in a batchwise exhaust process. The solution may be applied to one surface of the fabric or to both surfaces. In some embodiments, a solution of the polymer or copolymer is placed in a vat. The fabric is transferred through the polymer solution in the vat by dipping, preferably on a continuous basis. After passing through the polymer solution in the vat, the fabric preferably passes between two or more nip pressure rolls to remove the majority of the excess polymer solution. Although polymer cross linking may occur at room temperature, the fabric which has been treated with the polymer solution is preferably dried in a dryer after passing through the rollers.

The drying process can serve at least two purposes. First, it removes water to dry the polymer-treated fabric. Second, heating the polymer on the fabric surface can lead to cross linking of the polymer, making it more water insoluble. The cross linking or curing of the polymer preferably occurs at a temperature of between 200° and 300° F., more preferably between 250° and 280° F., and most preferably at 280° F. The curing of the polymer preferably takes less than approximately 2 minutes, more preferably between approximately 10 and 60 seconds, and most preferably approximately 20 seconds.

A second type of chemical which can advantageously be applied to the fabric is a softener. Although the softener can be a variety of chemicals, cationic softeners are advantageous. One especially preferred type of softener is a quaternary ammonium salt. Two exemplary softeners suitable for use with the present invention are Amerisoft PM or Amerisoft TP-54, marketed by Ameritex of Santa Fe Springs, Calif., and EC-200, marketed by Excel Products of Newport Beach, Calif. Although the invention is not limited to these two softeners, they have been found to be suitable for use in the present invention. The softener acts to improve the waterfastness and hand characteristics of the fabric which is to be printed with ink by ink jet printing.

Application of the softener alone, without any other chemical, has been found to give favorable results in tests of ink jet printing onto fabrics, as will be described in more detail later. Although application of the softener alone in general gives comparable results to application of the polymer or copolymer alone, the softener can act synergistically with the polymer/copolymer, and a combination of the polymer/copolymer and the softener is often preferred over using either chemical alone, though either alone can be effective at enhancing the ink jet printing of the fabric. The application of applying two or more chemicals to the fabric can involve tradeoffs of improved waterfastness versus reduced hand, for example. Some of these tradeoffs will become clear in the examples to be presented later. The softener can be applied by the same methods as discussed above for the polymer or copolymer.

If the fabric is to be treated with both a polymer or copolymer and a softener, the softener may be applied together with the polymer or alternatively may be applied either before or after the polymer. In general, it is advantageous to apply the polymer or copolymer together with the softener to obtain the best results.

A third chemical which can be applied to the fabric is a binder. The binder provides additional color intensity and superior waterfastness. Although many forms of binder may be used, it is generally advantageous to use a cationic binder. Again, one possible reason for the effectiveness of cationic binders is that the cationic binders electrostatically attract anionic dyes, as postulated for the previously described cationic polymers or copolymers. The cationic polymers or copolymers and the cationic binders may therefore act as mordants to help bind the anionic dyes to the fabric, minimizing their spreading. One exemplary binder is Acramin GD, manufactured by Bayer Corporation and marketed by Ameritex of Santa Fe Springs, Calif. Acramin GD is a cationic acrylic copolymer. Other binders are also suitable for use in the present invention. The binder may be applied together with the softener and the polymer, or it may be applied before or after the polymer and the softener.

Although the binder may be applied to the fabric alone without either a polymer/copolymer or a softener, the binder is normally much more effective if it is applied to the fabric in combination with either the polymer or copolymer and/or the softener. Preferably the binder is applied in combination with the polymer or copolymer. Advantageously, it may be applied in combination with both the polymer or copolymer and the softener. If the binder is to be applied in combination with either the polymer/copolymer and/or the softener, it may be applied before, after, or together with any of the other chemicals. Advantageously, it is applied to the fabric together with the other chemicals.

Although it is often preferred to apply all three chemicals, the polymer or copolymer, the softener, and the binder, there are tradeoffs to using all three chemicals, which will become evident in conjunction with the examples presented below. It may be advantageous for certain applications to apply only one or two of the chemicals to the fabric rather than all three. For instance, although adding the binder to the fabric in combination with the polymer or copolymer and the softener may improve the waterfastness and color intensity, the hand of the fabric may be degraded by the presence of the binder. Thus, in some applications where the hand of the fabric is an important factor, it may be advantageous to omit the binder from the solution which is to be applied to the fabric.

In addition, it may be advantageous to use more than one form of one or more of each of the three types of chemicals. For example, superior results may be obtained by using two or more types of polymer/copolymer rather than a single type. Similarly, two or more different softeners or binders may be added as well.

The polymer or copolymer, softener, and the binder can be applied to both natural and synthetic fibers, woven or knitted in a variety of styles. The fabric can be a variety of materials, including, but not limited to: natural fibers such as cotton, hemp, viscose, etc.; protein such as wool or silk; nylon, polyamide, polyester, polyacrylonitrile, as well as others. The polymer, softener, and binder, either individually or as a combination of two or three components is compatible with natural fibers such as cotton, silk and wool and also with synthetic polyester and polyamide fabrics. Advantageously, the fabric is dried after the chemicals are applied. As described earlier in relation to the polymer/copolymer, drying the fabric can help to bind the chemicals more strongly to the fabric so that they are not removed in subsequent processing.

It may further be noted that the thickness of the coating on the fabric may be varied by altering the concentration of solids in the solution, and/or by changing roll pressures or other process parameters. Suitable coating thicknesses typically range from 0.1 to 50 microns, with 0.5 to 5 microns being advantageous, and approximately 2 or 3 microns being especially advantageous.

In prior art treatment techniques or ink jet printing, such as is described in U.S. Pat. No. 4,702,742 to Iwata et al., the type of dye to be applied varied depending on the type of fabric. For example, direct dyes and reactive dyes were preferred for cellulose-based fabrics. Acid dyes were preferred for wool, silk, nylon, or polyamide. Basic dyes were preferred for acyl fabrics. With the methods of the present invention, the same dyes may be used with a wide variety of fabrics with good results.

In addition, the ink acceptors of Iwata, et al., were removed by washing. The chemicals used by the present invention, particularly the polymer or copolymer, are generally made water insoluble in the drying step without significantly impacting the characteristics of the fabric. The fabrics treated with the polymer or copolymer, softener, and/or binder as described herein tend to retain the coating and can normally be printed, either for the first or succeeding times, after washing. Being able to print the fabric after washing may have advantages in certain applications. Printing after washing is not appropriate to the method according to Iwata, et al., because the ink receptors of Iwata et al. are removed during the washing process.

The combination of polymer or copolymer, softener, and/or binder provides good waterfastness when applied in amounts of 0.05 to 40 wt %, more preferably in amounts of 1 to 30 wt %, and most preferably 5 to 15 wt %. The ratio of polymer or copolymer to softener to binder can be from 2.5:1:1 to 10:1:0 or 0:10:10. Other chemicals in addition to the polymer or copolymer, softener, and the binder can also be advantageously applied to the fabric. For example, a tannin salt can be combined with one or more of these chemicals to act as a mordant. The tannin salt can be added to the fabric as a mordant in an amount of 0.1 to 1% by weight, preferably 0.1 to 0.5% by weight, more preferably 0.25 to 0.5% by weight, and most preferably approximately 0.25% by weight.

The dye for the ink to be applied to the fabric by ink jet printing comprises a variety of materials. Advantageously the dye is an anionic dye acid dye, direct dye, reactive dye, or vat dye. Some examples of suitable dyes include, but are not limited to, Acid Blue 9, Direct Blue 199, Direct Blue 86, Acid Red 52, Reactive Red 180, Reactive Red 120, Acid Yellow 23, Direct Yellow 86, Direct Black 168, and Food Black 2.

The ink for the ink jet process for use in the present invention can be prepared by dissolving the dye as mentioned above in a medium to a concentration of about 0.1 to about 15% by weight. The ink medium is water alone, or preferably a mixture of water and a water-soluble organic solvent. The organic solvent for use in the present invention includes alkyl alcohols having 1 to 4 carbon atoms such as methyl alcohol, ethyl alcohol, isobutyl alcohol, etc; amides such as dimethyl formamide, dimethyl acetamide, etc; ketones or ketoalcohols such as acetone, diacetone alcohol, etc.; ethers such as tetrahydrofuran, dioxane, etc; polyalkylene glycols such as polyethylene glycol, propylene glycol, butylene glycol, hexylene glycol, diethylene glycol, etc.; glycerine; lower alkyl ethers of polyhydridic alcohol such as ethylene glycol methyl (or ethyl) ether, diethylene glycol methyl (or ethyl) ether, triethylene glycol mono-methyl (or ethyl) ether, etc.; 2-pyrrolidone, N-methyl-2-pyrrolidone, 1,3-dimethyl-2-imidazolidinone, etc.

The medium can comprise water or a mixture of water and one or more of the above-mentioned solvents. The most preferable medium comprises water and at least one water-soluble organic solvent. Preferably, the water-soluble solvent contains at least one water-soluble, high boiling organic solvent such as a polyhydridic alcohol, for example ethylene glycol, propylene glycol, glycerine, etc.

The ink can be prepared by mixing or milling the dye and medium and adjusting the pH to 4–10. The particle size of the dye is normally not more than about 30 $\mu$m, preferably not more than about 20 $\mu$m. If the particle size is too large there will be problems of nozzle clogging, etc. during the ink jet printing or in the levelling property in the following dye-fixing step. Other dispersants, surfactants, viscosity-controlling agents, defoaming agents, antiseptics, ionic salts, etc. can be added to the ink, if required.

Any ink jet printing process can be used, including, but not limited to, electrostatic attraction, high pressure, piezo process, thermal, and other drop on demand ejection processes. The ink is advantageously applied with the thermal ink jet printing process. In each of these ink jet procedures, the fabric is dyed by selectively depositing individual drops of ink in a computer controlled dot matrix pattern onto the textile substrate. Furthermore, in ink jet printing, a set of process colors, such as cyan, magenta, yellow, and black (CMYK), are used to create the full color gamut by control of the drop density of the process colors in a given region of the substrate. This is in contrast to bulk dying or other conventional textile printing procedures where relatively large sections of fabric are immersed into or covered with a desired color dye.

After the ink is deposited onto the fabric by conventional processes, it is sometimes advantageous to additionally fix the dye onto the cloth. The dye-fixing treatment depends on the species of dye and type of cloth, but can be selected from steaming, heating with warm or hot water, dry heating, or treating with a surfactant-containing solution, etc. When the fabric is treated with the polymer or copolymer, softener, and/or the binder of the present invention, and the treated fabric is printed by the ink jet process, fixing the dye according to one of the above-processes is normally not necessary. The ability to avoid fixation of the dye after printing onto the fabric is one of the many advantages of printing textile material with the method of the present invention.

The following example describes a suitable method for coating a cotton fabric with a solution containing polymer or copolymer and softener and coating, drying, and printing the fabric.

EXAMPLE 1

Preparation of the Coating Solution Containing Polymer/Copolymer Softener, Coating, Drying, and Printing a Cotton Fabric A total of 65 liters of deionized water was introduced into a 500 liter cylindrical stainless steel container. 25 kilograms of polymer/copolymer solution, purchased from Centigrade Chemicals of Coral Springs, Fla., as a 25% solids solution in water, under the commercial name Index was added to the water. A total of 10 kilograms of a softener solution purchased from Ameritex, Santa Fe Springs, Calif., as a 10% solids solution in water under the commercial name Amerisoft PM or Amerisoft TP-54 was then added to the solution. The resulting concentrations of polymer/copolymer solution and softener solution were 25 and 10 weight % of solution, respectively, thereby producing 6.25% by weight solids polymer/copolymer and 1% by weight solids softener in the final solution. The solution was mixed with a mechanical propeller stirrer for 30 to 60 minutes at 2000 rpm.

Please note that the concentrations in this example, in the Tables, and throughout this application are as weight percent of the solutions as purchased, unless specifically otherwise noted as weight percent solids. As the Tannin salt is obtained as a solid, its concentration is reported as the weight % of the solid in all cases.

The solution was then pumped into a saturation vessel of a 60 inch wide coating frame line provided with padded rubber rollers with adjustable pressure. A 100% cotton poplin fabric, 60 inches wide, 4–8 oz. fabric, which had been sueded was passed through the solution at a line speed of 55 yards per minute and pad pressure of 3.5 tons to get 70–75%, preferably close to 70%, wet pick up.

The fabric was then passed through a 60 foot long, 100 inch wide oven at a rate of 180 feet per minute with the oven heated to 280° F. to dry the fabric and cure and cross link the polymer/copolymer and softener mixture on the surface of the fabric. The residence time of the fabric in the oven was approximately 20 seconds.

The fabric was printed with an Encad NovaJet PRO 60e Model 1500 TX thermal ink jet printer using anionic dyes such as those listed previously having the colors of Cyan, Magenta, Yellow, and Black. The printed fabric had an optical density of 1.09 both before and after washing.

The fabric which was treated with polymer/copolymer and softener before printing therefore had good optical density and excellent waterfastness. The results of the test are shown in Table 2 as Sample 1-E.

An outline of the general procedure is given in FIG. 1. This flow chart illustrates one embodiment of the overall process. Referring now to this Figure, at step 10, the textile is dipped in a polymer solution. At step 20, the coated textile is then printed with an ink jet printer. The optical density (OD) of the printed fabric is determined at step 30. The fabric is washed at step 40 according to American Association of Textile Chemists and Colorists (AATCC) Method 107–1991. This process involves immersing the fabric in water for 15 minutes, and oven drying the fabric between two glass plates. The fabric is laid against a fabric standard. Color loss and color transfer, as well as the optical density, is determined after washing as a measure of the waterfastness of the dye. As demonstrated by the following examples, the OD after washing is often over 90% of the OD before washing. In some cases, the OD after washing is over 95% of the original, or may even show an increase of up to an additional 20% over the OD measured prior to the washing step. For polyester fabrics, discussed more fully below, the OD after washing is at least about 85% of the original optical density, and in some cases up to 100% of the original optical density.

A series of tests with the above general procedure were conducted to identify the important variables. The polymers/copolymers, softeners, and binders which were used in these tests are shown in Table 1. The results of the tests are shown in Tables 2 and 3.

TABLE 1

Polymers/Copolymers, Softeners, Binders, and Tannin Salt Used in Tests

| Code Letter | Commercial Name | Company | Location |
|---|---|---|---|
| | | Polymers/Copolymers | |
| I | Index | Centigrade Chemicals | Coral Springs, Florida |
| P-100 | Pretreat 100 | Excel Products | Newport Beach, California |
| B-121 | Bayhydrol 121 | Bayer Chemical | Pittsburgh, Pennsylvania |
| P-CD | Pretreat CD | Excel Products | Newport Beach, California |
| | | Softeners | |
| S | Amerisoft PM or Amerisoft TP-54 | Ameritex | Santa Fe Springs, California |
| EC-200 | Extrasoft C-200 | Excel Products | Newport Beach, California |
| | | Binders | |
| B | Acramin GD | Manufactured by Bayer Corporation | Pittsburgh, Pennsylvania |
| | | Tannin Salt | |
| Ts | | Ameritex | Santa Fe Springs, California |

The Index, Pretreat 100, and Pretreat CD polymers are cationic. Index contains epichlorohydrin and polyalkylene polyamine. Pretreat 100 and Pretreat CD both contain high percentages of epichlorohydrin. Bayhydrol 121 is a neutral polyurethane polymer, available as 35% solids in water from Bayer Chemicals. The softeners Amerisoft PM and Extrasoft C-200 are quaternary fatty amides. The Acramin GD binder is an acrylic copolymer with a cationic moiety.

The results of a series of experiments varying the amounts and types of chemicals in the coating solution for the pretreatment of cotton before printing with an ink jet printer according to the general method of Example 1 are shown in Table 2. The results for another set of tests performed on polyester fabric are shown in Table 3.

The waterfastness and hand of each printed fabric were measured. The optical density was measured with a Macbeth Model TR 927 for black only. The waterfastness evaluation was judged on all printed colors based on AATCC colorfastness to water, Test Number 107-1991. The waterfastness tests were rated on the following basis: excellent=5; very good=4; good=3; OK=2; poor=1; and very poor=0 or none.

TABLE 2

Effect of Coating Composition on Intensity Waterfastness and Hand on Cotton Fabric

| Example | Pre-Wash OD | After Wash OD | Fastness Fastness | Hand/ Feel | Treatment Composition (wt %) |
|---|---|---|---|---|---|
| 1-A | 1.17 | 1.2 | Excellent | Good | 4% I, 2% S, 2% B |
| 1-B | 1.05 | 1.14 | Excellent | Good-OK | 4% I, 4% B |
| 1-C | 1.08 | 1.13 | Excellent | Very Good | 4% I, 4% S |
| 1-D | 0.96 | 0.84 | OK-Good | Good | 4% I, 4% S, 0.25% Ts |
| 1-E | 1.09 | 1.09 | Very Good | Very Good | 25% I, 10% S |
| 1-F | 1.11 | 0.95 | Very Good | Good | 8% I |
| 1-G | 1.06 | 1.04 | Very Good | Excellent | 8% S |
| 1-H | 1.11 | 0.93 | Poor | Good | 4% S, 4% B |
| 1-I | 1.H | <0.5 | Very Poor | Not Applicable | Water |
| 1-J | 1.12 | <0.5 | Very Poor | Not Applicable | As Is |
| 1-K | 1 | 0.81 | Poor | OK | 8% B |
| 1-L | 1.18 | 1.28 | Excellent | Very Good | 25% P-100, 10% S |
| 1-M | 1.19 | 1.15 | Excellent | Very Good | 25% P-100, 10% EC-200 |
| 1-N | 1.1 | 1.15 | OK-Good* | OK-Good | 8% P-CD |
| 1-O | 1.13 | 1.13 | Very Good* | Good | 25% P-CD, 10% S |
| 1-P | 1.12 | 1.18 | Excellent | Good | 4% P-CD, 4% P-100 |
| 1-Q | 1A6 | 1.1 | Good | Good | 8% P-100 |
| 2-A | 1.25 | 0.6 | Poor | OK | 10% B-121, 0% S |
| 2-B | 1.25 | 0.7 | Poor | Good | 10% B-121, 4% S |
| 2-C | 1.3 | 0.5 | Very Poor | Good | 10% B-121, 15% S |
| 3-A | 1.14 | 1.2 | Very Good | Very Good | 25% I, 10% S |
| 3-B | 1.14 | 1.2 | Very Good | Very Good | 3-A Printed a Second Time After Washing |

*in Water fastness column means yellowing fabric

The results of the tests shown in Table 2 demonstrate several aspects of the present invention. First, all of the printed cotton fabric samples had good to excellent color intensity before washing. The major difference in the examples was in the effect of washing on the color intensity, that is, the degree of waterfastness. If the color intensity decreased significantly on washing, the printed fabric was demonstrated to have poor waterfastness, an undesirable trait.

Examples 1-I and 1-J comprise untreated controls. The cotton fabric in Example 1-I was printed after treatment with water alone, with no chemicals. It had very poor waterfastness. Similarly, the fabric used in Example 1-J was printed as-is, with no treatment of any kind. The printed fabric of Example 1-J also exhibited very poor waterfastness.

By contrast, the cotton samples which were treated with the cationic polymers Index or P-100 and the tetraalkylammonium salt softener Amerisoft PM or EC-200 or alternatively the cationic binder Acramin GD showed good waterfastness.

Thus, Examples 1-A to 1-F were all pretreated with a solution containing the cationic Index polymer. The coating solutions used in pretreating all of the fabrics in these examples except Example 1-F also contained either the quaternary fatty amide softener Amerisoft PM, the cationic binder Acramin GD, or both. All showed good waterfastness. Treating the cotton fabric with a coating solution containing the cationic polymer Index either alone or in combination with the cationic softener and/or the cationic binder gave good colorfastness in the cotton fabric printed through ink jet printing. The fabrics of Examples 1-I and 1-J, which were not treated with these chemicals, had very poor waterfastness. Treatment of the cotton fabric with the coating solution containing the chemicals of the present invention gave improved waterfastness over fabrics which were not treated with these coating solutions.

Similarly, the cotton fabrics used in Examples 1-L to 1-P were pretreated with the cationic polymer P-100 and/or the cationic polymer P-CD, either alone or in combination with the tetraalkylammonium salt softeners Amerisoft PM or EC-200. All had good waterfastness. The only exception was the fabric of Example 1-N, which was pretreated with a coating solution containing only P-CD. Although the printed intensity of the printed fabric of Example 1-N increased after washing, the waterfastness was judged to be OK-Good. The fabrics of Examples 1-N and 1-O pretreated with a solution containing the polymer/copolymer P-CD exhibited yellowing. The pretreatment of the cotton fabric with a coating solution containing the cationic polymers P-100 or P-CD or both, either alone or in combination with a softener gives good colorfastness after printing with ink jet printing.

In fact, the color intensity of the cotton fabrics which were treated with the coating solutions containing the cationic polymers, either alone or in combination with a softener, binder, or both was often more intense after washing than before. Not only was the waterfastness excellent, the color intensity actually increased in many cases after washing.

The cotton fabrics which were treated with coating solutions containing the cationic polymer P-100 appear to have greater color intensity than the fabrics which were treated with a coating solution containing the cationic polymer Index. For example, Example 1-E was prepared with a solution containing 25% Index polymer and 10% Amerisoft PM softener, while Example 1-L was prepared with a solution containing 25% P-100 and 8% Amerisoft PM. Example 1-L, prepared with P-100, had pre- and after wash OD's of 1.18 and 1.28, compared to the OD's of 1.09 and 1.09 for Example 1-E, prepared with a solution of Index.

Several of the cotton fabric samples were dried with a heat gun rather than in an oven. Varying the method of drying the 100% cotton poplin fabric appeared to have little or no effect on the waterfastness.

The following example shows the effect of adding a nonionic polymer in place of the cationic polymers used in the coating solutions of Example 1.

EXAMPLE 2

Effect of Using a Nonionic Polymer in the Coating Solution With Cotton Fabric

A sample of 100% cotton poplin was treated with a coating solution, dried and printed with an ink jet printer according to the general procedure of Example 1. However, a neutral polyurethane polymer, Bayhydrol 121 from Bayer Chemical, available in 35% solid dispersed in water was used in place of the cationic polymers of Example 1.

Three samples of poplin fabric were treated with coating solutions containing 10% Bayhydrol 121 and 0, 4, and 15 wt % of the softener Amerisoft PM, respectively. These samples are listed in Table 2 as Examples 2-A, 2-B, and 2-C, respectively. The optical density of the three printed fabrics was 1.25, 1.25, and 1.3, but the printed fabrics showed poor, poor, and very poor waterfastness, respectively.

Example 2 therefore demonstrates that use of a neutral polymer in place of the cationic polymers of Example 1 gives printed fabrics having poor waterfastness.

The following example demonstrates that the fabrics pretreated with the coating solution of the present invention can be printed through the ink jet process a second time, even after it has been washed.

EXAMPLE 3

Treat-Wash-Print Cycle On Cotton Fabric

A sample of cotton fabric was treated with a coating solution containing 25% Index and 10% Amerisoft PM and printed. After the sample was washed to determine its waterfastness, the fabric was printed and washed again. Although the example shown in Table 2 as Examples 3-A and 3-B had no change in optical density when printed a second time, in some experiments, the optical density gains significantly when printed after washing with the ink jet printing process.

The preceding example demonstrates that the coating is not removed by washing, and the fabric can be printed a second time, even after washing. The fabric coatings of earlier inventions were removed by washing, and a second ink jet printing step would not have been effective.

The following examples describe the results of experiments performed on polyester fabric of the type stretched crepe. The experiments on polyester are summarized in Table 3.

TABLE 3

Effects of Coating Comiposition and Heating Method on Intensity Waterfastness and Hand for Printed Polyester Fabric

| Example | Pre-Wash OD | After Wash OD | Water-Fastness | Hand | Treatment Composition (wt %) |
|---|---|---|---|---|---|
| 4 | 1.05 | 0.93 | Good | Very Good | 25% I, 10% S Controlled Cure |
| 5-A | 1.05 | <0.5 | Poor | Very Good | 25% I, 10% S Heat Gun |
| 5-B | 1.05 | <0.5 | None | Good | 25% I, 10% S Heat Gun |
| 6 | 1.05 | 1.05 | Excellent | Good | 4% I, 2% S, 2% B, 0.25% Ts Heat Gun |
| 7 | 1.05 | <0.5 | None | Very Good | 4% I, 4% S Heat Gun |
| 8A | 1.06 | <0.5 | None | Good | 25% P-100, 10% S Heat Gun |

TABLE 3-continued

Effects of Coating Comiposition and Heating Method on Intensity Waterfastness and Hand for Printed Polyester Fabric

| Example | Pre-Wash OD | After Wash OD | Water-Fastness | Hand | Treatment Composition (wt %) |
|---|---|---|---|---|---|
| 8B | 1 06 | 0.9 | Very Good | Very Good | 25% P-100, 10% S Controlled Cure |

The next example used the coating solution and procedure used for the cotton fabric of Example 1-E but with stretched crepe polyester fabric. The example demonstrates that the coating solution, drying procedure, and ink jet printing process can be used on polyester fabrics as well as cotton fabrics.

EXAMPLE 4

Ink Jet Printing of Polyester Stretched Crepe Fabric Treated with Index Polymer and Amerisoft PM Softener Stretched crepe polyester fabric was treated with a coating solution containing 25 wt % Index polymer and 10 wt % Amerisoft PM softener. The same procedure as described in Example 1 was used. The printed fabric showed an optical density of 1.05 and had good waterfastness.

Example 4 demonstrates that the coating solution, drying procedure, and ink jet printing process work well with polyester fabrics as well as with the cotton poplin fabric used in Example 1.

The following example demonstrates that polyester fabric is more sensitive to the drying procedure than was the cotton fabric used in Example 1.

EXAMPLE 5

Polyester Fabric Treated with Index Polymer and Amerisoft PM Softener-Dried with a Heat Gun Polyester stretched crepe fabric was treated with the coating solution of Example 4, but the coated fabric was not cured properly in the oven. The fabric was left wet for a period of 24 hours and was then cured with a heat gun at random temperatures between 50 and 100 degrees Centigrade. The printed fabric showed good optical density but had poor or no waterfastness. The experiment was performed twice with similar results. The data for the two samples are shown in Table 3 as Examples 5-A and 5-B.

Cotton fabric dried with a heat gun demonstrated good optical density and good waterfastness. The polyester fabric of Example 5 was treated in the identical manner as Example 4 except for the drying procedure. The printed polyester fabric of Example 5, dried with a heat gun, showed poor waterfastness, while the printed polyester fabric of Example 4, dried in an oven, had good waterfastness. These two examples demonstrate that, unlike the cotton fabric used in Example 1, polyester crepe fabric is sensitive to the drying procedure used after the fabric is coated with the coating solution.

The following example demonstrates that adding binder and Tannin salt to the coating solution improves the waterfastness of polyester fabric printed with the ink jet process.

EXAMPLE 6

Polyester Fabric Treated with Index Polymer, Amerisoft PM Softener, Ameritex GD Binder and Tannin Salt-Dried with a Heat Gun A coating solution was made up with 4 wt % Index polymer, 2 wt % Amerisoft PM softener, 2 wt % Ameritex GD cationic binder, and 0.25 wt % Tannin salt. Polyester crepe fabric was treated with this solution to 80% pick up and then dried using a heat gun. The printed fabric showed good optical density and excellent waterfastness.

The preceding example shows that the addition of binder and Tannin salt to the polymer and softener solution produced a printed polyester fabric with good waterfastness, even though the fabric was dried with a heat gun rather than in an oven.

The following example demonstrates that the binder and Tannin salt were the materials which produced the colorfastness in the polyester fabric of Example 6.

EXAMPLE 7

Polyester Fabric Treated with Index Polymer and Ameritex PM Softener-Dried with a Heat Gun Polyester fabric was treated with a coating solution containing 4 wt % Index polymer and 4 wt % Ameritex PM softener. The polyester fabric was treated with the coating solution to a wet pick up of 80% and dried with a heat gun. The ink jet printed polyester fabric had good optical density, but the waterfastness was poor.

The preceding example is the same as Example 6, except that the coating solution used in Example 7 had no binder or Tannin salt. The fact the polyester fabric of Example 7, with no binder or Tannin salt in the coating solution, had poor waterfastness shows that the use of binder and Tannin salt in the coating solution for the polyester fabric give the printed fabric good waterfastness.

The following example demonstrates two things. First, it shows that the Excel P-100 polymer/copolymer can successfully be used in place of the Index polymer/copolymer in the coating solution for treating polyester fabric before ink jet printing. Second, it is another demonstration that the drying step is more critical for polyester fabric than for cotton fabric.

EXAMPLE 8

Polyester Fabric Treated with P-100 Polymer and Ameritex PM Softener-Different Drying, Methods Give Different Results Two samples of polyester fabric were treated with a coating solution containing 25% Excel P-100 polymer/copolymer and 10% Ameritex PM softener. For Example 8A, the fabric was dried with a heat gun. The polyester fabric of Example 8B was dried in an oven with a controlled cure.

The results are shown in Table 3. The polyester fabric of Example 8A dried with a heat gun had no waterfastness. The polyester fabric of Example 9B, dried in a controlled cure, had very good waterfastness.

The fact that the polyester fabric of Example 8B had good waterfastness demonstrates that the Excel P-100 polymer/copolymer can be successfully used in place of the Index polymer/copolymer in the coating solution for polyester fabric. By contrast, the polyester fabric of Example 8A was treated in an identical fashion as that for Example 8B, except that the fabric of Example 8A was dried with a heat gun rather than in a controlled manner in an oven. The heat gun-dried polyester fabric of Example 8A had no waterfastness. The oven-dried polyester fabric of Example 8B had very good waterfastness. These two Examples are another demonstration that polyester fabric treated with the coating solution of the present invention is sensitive to the drying method. Polyester fabric which is dried with a heat gun is less likely to show good waterfastness after printing with an ink jet printer than is polyester fabric which is dried in a controlled fashion in a drying oven.

As demonstrated above, treatment of fabrics with a solution containing a cationic polymer/copolymer, a softener, and/or a cationic binder leads to improved color intensity and colorfastness over untreated fabric when the fabric is printed by the ink jet process. The same treatment procedures and dyes can be used on a wide variety of textile materials.

The foregoing description details certain preferred embodiments of the present invention and describes the best mode contemplated. It will be appreciated, however, that no matter how detailed the foregoing appears in text, the invention can be practiced in many ways. It should be noted that the use of particular terminology when describing certain features or aspects of the present invention should not be taken to imply that the broadest reasonable meaning of such terminology is not intended, or that the terminology is being re-defined herein to be restricted to including any specific characteristics of the features or aspects of the invention with which that terminology is associated. The scope of the present invention should therefore be construed in accordance with the appended Claims and any equivalents thereof.

What is claimed is:

1. A method of making a printed textile comprising the steps of:

contacting said textile with a solution having total dispersed solid content of approximately 8% to approximately 35% by weight comprising (1) approximately 4% to approximately 25% weight solids epihalohydrin copolymerized with polyalkylene polyamine and (2) approximately 4% to approximately 10% weight solids softener comprising a quaternary ammonium salt in a ratio of approximately 1:1 to approximately 2.5:1 epihalohydrin copolymerized with polyalkylene polyamine to quaternary ammonium salt;

drying said textile so as to form an ink acceptor layer on a surface of said textile; and ejecting ink droplets onto said surface of said textile.

2. The method of claim 1, wherein said aqueous solution in said immersing step additionally comprises approximately 0.01% to 10% weight solids acrylic copolymer with a cationic moiety.

3. The method of claim 1, wherein said drying step is performed at approximately 250 to 280 degrees Fahrenheit.

4. The method of claim 1, wherein said textile fabric comprises cotton fibers.

5. The method of claim 3, wherein said textile fabric comprises polyester fibers.

6. A method of printing fabric comprising:

coating said fabric with a solution comprising (1) a polymer or copolymer comprising an epihalohydrin or its precursors and a polyalkylene polyamine, (2) a softener comprising a tetraalkylammonium salt, and (3) an additional cationic binder different from both said polymer or copolymer of epihalohydrin or its precursors and a polyalkylene polyamine and from said tetraalkylammonium softener to form a coated fabric; and ejecting droplets of ink onto said coated fabric with an inkjet printer.

7. The method of claim 6, additionally comprising the step of drying said fabric after the coating step.

8. The method of claim 6, wherein said polymer or copolymer is cationic.

9. The method of claim 8, wherein said droplets of ink comprise an anionic dye.

10. The method of claim 6, wherein the fabric is chosen from the group consisting of cotton, hemp, wool, viscose, nylon, polyamide, polyester, polyacrylonitrile, and blends thereof.

11. The method of claim 6, additionally comprising the steps of:

washing said printed fabric; and repeating the step of ejecting droplets of ink onto said coated fabric.

12. A method of printing on fabric comprising:

treating the fabric with a solution comprising a polymer or copolymer comprising an epihalohydrin or its precursors and a polyalkylene polyamine; and a softener comprising an tetraalkylammonium salt;

ejecting ink droplets onto said coated fabric with ink from an ink jet printer to print a pattern on said fabric; and repeating the step of ejecting droplets of ink onto said coated fabric to re-print said pattern on said fabric.

13. The method of claim 12, wherein the coated polyester fabric is cured at a temperature of approximately 250 to 280 degrees Fahrenheit.

14. A method of printing on polyester fabric comprising:

treating the polyester fabric with a solution comprising a polymer or copolymer comprising an epihalohydrin or its precursors and a polyalkylene polyamine and a tannin salt to form a coated polyester fabric; and printing on said coated polyester fabric with an ink jet printer.

15. The method of claim 14, wherein the coated polyester fabric is dried before printing.

16. The method of claim 1, wherein said solution is essentially free of additional polymeric binders.

17. A method of making a printed textile comprising:

immersing said textile in a solution consisting essentially of (1) solvent, (2) a polymer or copolymer comprising an epihalohydrin or its precursors, and (3) a tetraalkylammonium salt softener;

drying said textile; and ejecting ink droplets onto said textile.

* * * * *